US006701571B2

(12) United States Patent
Hagen

(10) Patent No.: US 6,701,571 B2
(45) Date of Patent: Mar. 9, 2004

(54) CARRYING HANDLE

(75) Inventor: Ronald G. Hagen, Larsen, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 10/112,422

(22) Filed: Mar. 28, 2002

(65) Prior Publication Data

US 2003/0182760 A1 Oct. 2, 2003

(51) Int. Cl.[7] ..... A45C 3/00; A45F 5/10

(52) U.S. Cl. ..... 16/114.1; 16/DIG. 12; 16/DIG. 19

(58) Field of Search ..... 16/114.1, 442, 16/428, 443, 444, 446, DIG. 12, DIG. 19; 383/6, 11, 14–16, 21, 22, 23; 206/432, 497; 264/544, 550, 551–554; 493/226

(56) References Cited

U.S. PATENT DOCUMENTS

| | | | | |
|---|---|---|---|---|
| 1,691,741 A | | 11/1928 | Snyder | |
| 2,437,072 A | | 3/1948 | Campbell | |
| 2,722,368 A | | 11/1955 | Gottsegen | |
| 3,016,136 A | * | 1/1962 | Poupitch | 206/527 |
| 3,142,436 A | | 7/1964 | Heigl | |
| 3,253,593 A | | 5/1966 | Cronin, Jr. | |
| 3,309,008 A | | 3/1967 | Huck | |
| 3,877,352 A | | 4/1975 | Brieske | |
| 4,119,268 A | | 10/1978 | Segura | |
| 4,481,668 A | * | 11/1984 | Hammacher | 383/7 |
| 5,174,657 A | * | 12/1992 | Peppiatt | 383/8 |
| 5,881,432 A | * | 3/1999 | Good | 16/426 |

FOREIGN PATENT DOCUMENTS

| | | | |
|---|---|---|---|
| FR | 2147099 | * | 3/1973 |
| GB | 2038777 A | * | 7/1980 |
| GB | 2255497 A | * | 11/1992 |
| JP | 2000109100 | * | 4/2000 |

* cited by examiner

*Primary Examiner*—Chuck Y. Mah
(74) *Attorney, Agent, or Firm*—Quarles Brady LLP

(57) ABSTRACT

A self-adhesive handle for carrying a bag, container, package or the like is formed prior to use into a flat structure having three plies secured to a release liner. A first ply defines a first panel having a junction dividing the first panel into first and second panel parts. The first panel part has an outer edge and a first cut line defining a first hand receiving opening. A second ply defines a second panel extending in a plane substantially parallel with the first panel part and sharing an outer edge with the first panel part and extending to an inner edge adjacent to the junction between the first and second parts of the first panel. The second panel has a second cut line defining a second hand receiving opening at least partially in registration with the first hand receiving opening. A third ply defines a third panel substantially coplanar with the second panel part and sharing an inner edge with the second panel. Undersides of the second panel part and the third panel are releasably adhered to the release liner. A method of making the handles folds them from a continuous web.

10 Claims, 2 Drawing Sheets

CARRYING HANDLE

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

1. Field of the Invention

This invention relates to handles for carrying items, such as packages, bags, cartons or other containers, and more particularly, to adhesively applied handles.

2. Discussion of the Prior Art

It is well-known that handles can be attached to items to facilitate carrying. Handles can be attached directly to objects designed to be carried or to the containers or packaging housing the items, for example, cardboard boxes and paper and plastic bags. These containers can have separate handles attached to the container in some way or they can be a unitary part of the container, formed as appendages or hand-receiving openings.

A common problem with handles made of the same material as the product packaging is that they are prone to tearing or breaking under the weight of the product unless the entire packaging is made of high-strength materials, which is disadvantageous for reasons of cost. To overcome this problem, the present invention provides adhesively attachable handles, made of relatively high strength materials. In this way, stronger, more costly materials need only be used at the handle where the stresses are the greatest. It also makes opening the package easier for the consumer, since the package doesn't need to be made out of the same high strength material as the handle.

Also, some bag or box styles do not include or can't be made to include a handle. Therefore, an attachable handle can be used with these styles of packages.

Known adhered handles have suffered from drawbacks such the means of attaching the handle, complex structure and difficult assembly or application.

Accordingly, a need exists for an improved adhered carrying handle.

SUMMARY OF THE INVENTION

The present invention provides a high-strength adhered carrying handle that, among other things, can be adhered to bags, cartons and packages of any shape and are formed flat to be compactly stored and readily assembled, or provided on a continuous web and automatically applied.

Specifically, the invention is a handle for carrying a bag, container, package or the like formed into a structure secured to a release liner. The handle has first, second and third panels. The first panel has contiguous first and second panel parts. The first panel part has an outer edge and a first cut line defining a first hand receiving opening. The second panel extends in a plane substantially parallel with the first panel part from the outer edge of the first panel part to an inner edge adjacent to the junction between the first and second parts of the first panel. The second panel has a second cut line defining a second hand receiving opening at least partially in registration with the first hand receiving opening.

The third panel is substantially coplanar with the second panel part and has an inner edge extending from the inner edge of the second panel. Undersides of the second panel part and the third panel are releasably adhered to the release liner.

In a preferred form, the handle is a single sheet of material folded flat to form the first, second and third panels. Fold lines form the outer edges of the first panel part and the second panel and the inner edges of the second and third panels. The second and third panels are releasably joined by a dry release adhesive to maintain a flat profile of the handle on the release liner and on the package, until the handle is used by a user.

The invention can provide a spool or a fan-folded stack of handles on a continuous web or strip of release liner. The release liner is releasably adhered to a plurality of handles for use in automated assembly of the handles to product packaging. The plurality of handles are preferably spaced from each other in alignment as needed depending on the size of the package and the rate it is traveling when the handle is being assembled. The folds of the handle are preferably parallel to the machine direction of application of the handles.

The handle can be attached automatically or manually via the adhesive at the underside of the second panel part and the third panel to a package at a single upper surface or multiple side (and/or top) surfaces.

The sheet material forming the panels is preferably a high-strength plastic film, the grade and gauge of which is selected according to the size and weight of the item to be contained in the package. Also, the first panel part and the second panel preferably include two arcuate slits at the ends of their respective cut lines forming the hand-receiving openings. These arcuate slits increase the stresses that the handle can withstand at the sides of a person's hand holding the handle.

In a method of making a series of handles of the invention from a continuous web, for each series of handles to be made in the web, a series of sets of two hand holes are cut for each handle, each set of two hand holes being spaced apart in a machine direction from the next set of two hand holes. The two hand holes of each set are formed opposite from one another on opposite sides of an outer edge of a first panel part of each handle. Two spaced apart and parallel folds are made in the web parallel to the machine direction such that the first fold corresponds to the outer edge of the first panel part and the second fold corresponds to the inner edge of a second panel which overlaps the first panel part of the first panel. The first panel extends beyond the second fold and the second fold also corresponds to the inner edge of a third panel which overlaps the second panel, so as to provide the web in a generally flat state.

The second panel may be releasably adhered to the third panel to hold them flat together, and cuts may be made perpendicular to the machine direction between each set of two hand holes to separate individual handles from one another. In addition, the folded web may be releasably adhered to a release liner before cutting the web into individual handles, and the release liner may be rolled up, fan folded or cut apart into individual units.

The foregoing and other objects and advantages of the invention will appear from the following description. In this description reference is made to the accompanying drawings which form a part hereof and in which there is shown by way of illustration preferred embodiments of the invention. Such embodiments do not necessarily represent the full scope of the invention, however, and reference must be made therefore to the claims for interpreting the scope of the invention.

DETAILED DESCRIPTION OF THE PREFERRED EMBODIMENTS

Figure 1A:
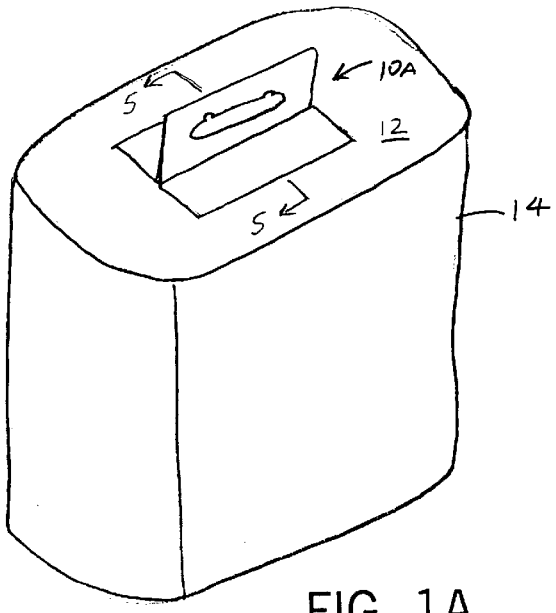
FIG. 1A is a perspective view of a self-adhesive handle according to the present invention as it would appear when adhered to the top surface of an object or package.
Figure 1B:
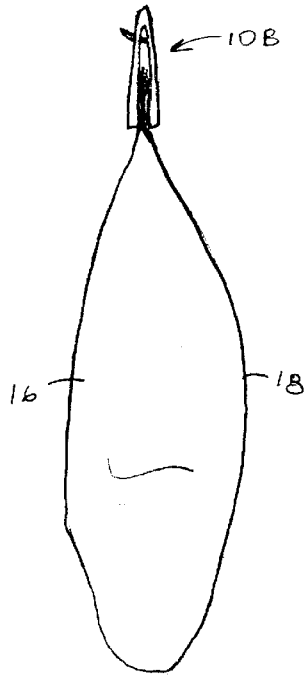
FIG. 1B is a end view of the handle as it would appear attached to the sides of a bag.

The present invention provides a high-strength adherable carrying handle that can be quickly adhered to one or more surfaces of a package, bag, carton (or other container) and any other object requiring one or more handles. FIG. 1A shows the handle in one configuration 10A adhered to a top surface 12 of a package 14 and FIG. 1B shows the handle in another configuration 10B adhered to upper portions of opposite sides 16 and 18 of a bag 20.

Figure 3:
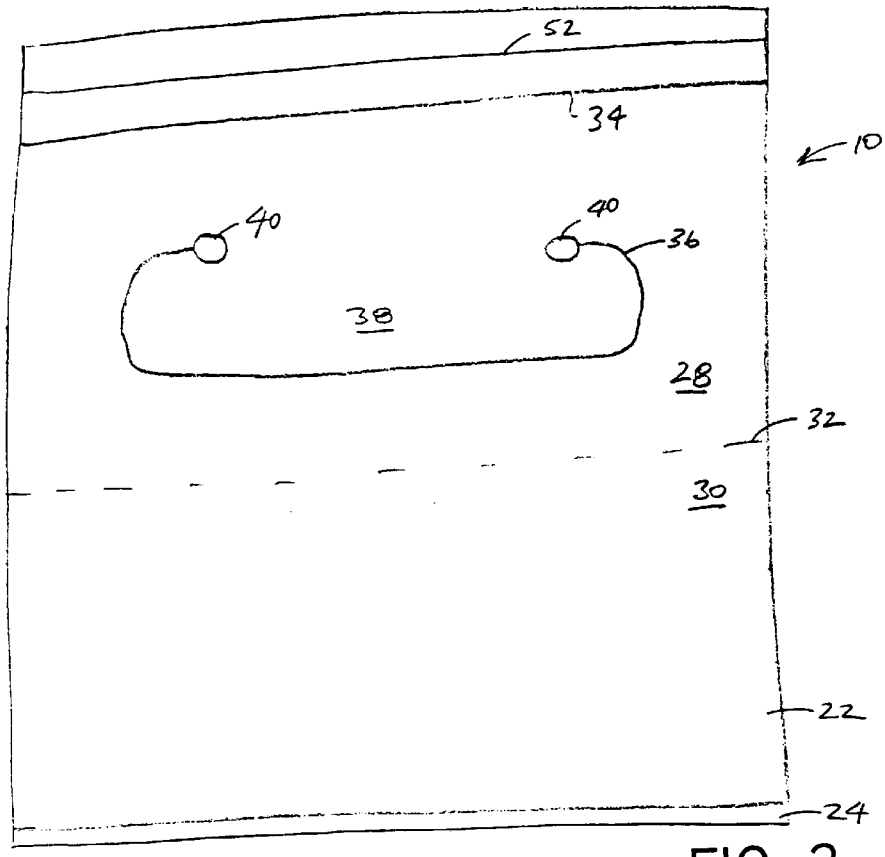
FIG. 3 is a front view of a single handle of FIG. 2.
Figure 4:
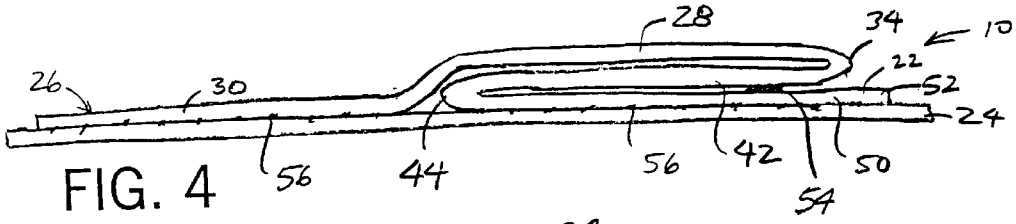
FIG. 4 is a right end view of the handle of FIG. 3.

The handle 10 is formed, for storage, sale and assembly before use, as a flat rectangular structure having an overall height of approximately three mils. Referring to FIGS. 3 and 4, the handle 10 is formed of a single sheet 22 of high-strength film material folded into the shown configuration and preferably adhered to a conventional release liner 24 having a smooth release coating at the contacting surface.

Specifically, the sheet 22 is folded as shown in FIGS. 3 and 4. A first ply of the folded sheet defines a first panel 26, shown in FIG. 3 as having a generally rectangular outline, however, it could be cut to define any suitable curved or rectilinear shape. The first panel 26 is divided into first 28 and second 30 panel parts substantially along a junction 32, which is approximately the centerline of the first panel 26. The first panel part 28 is raised slightly from the second panel part 20 and extends from the junction 32 to an outer edge 34. The first panel part 28 is die cut to include a first hand receiving opening 36 extending lengthwise at the middle of the first panel part 28. The opening 36 is oblong and sized to accommodate the width of a person's fingers. The cut line defining the opening 36 has a generally flattened U-shape such that the sheet forms a flap 38 connected to the first panel part 28 at one edge. The cut line also defines two arcuate slits, shown as circular openings 40, at the ends of the cut line.

The sheet 22 is folded over (clockwise as shown) at the outer edge 34 to define a second panel 42 extending in a plane substantially parallel with and overlapping the first panel part 28. The second panel 42 extends from the shared outer edge 34, where it is coterminous with the first panel part 28, to an inner edge 44 adjacent to the junction 32 between the first and second parts of the first panel 26. Like the first panel part 28, the second panel 42 is die cut with a second hand receiving opening 46. This opening 46 is identical to the first opening 36, including the circular openings, and is positioned in the second panel 42 so as to be substantially aligned with the first opening 36 and define flap 48. The facing surfaces of the first panel part 28 and the second panel 42 are not adhered and are free of adhesive.

The sheet 22 is folded over (counter-clockwise as shown) at the inner edge 44 to form a third ply defining a third panel 50 substantially parallel with and overlapping the second panel 42 and substantially coplanar with the second panel part 30 of the first panel 26. The third panel 50 extends to an outer edge 52 outside of the outer edge 34 of the first panel part 28. A bead of a low tack, dry release adhesive 54 is applied to the upper face of the third panel 50 to releasably secure to the second panel 42 and hold the sheet in this folded position. The undersides of the second panel part 30 and the third panel 50 are coated with a pressure sensitive adhesive 56 and are releasably adhered to the silicon surface of the release liner 24.

In one preferred method, the handles 10 are manufactured using a continuous web of Valeron®, commercially available from Illinois Tool Works, Inc., of Glenview, Ill., which is a cross-laminated polyolefin film used in the packaging industry for its high strength and tear resistance. The web is wide enough to form the aforementioned three plies and is die cut and folded as described before, being mated with a continuous sheet of release liner.

Specifically, the web is fed beneath a die cutter to cut the two handle receiving openings for each handle at spaced intervals. A 3/16" wide layer of a suitable quick drying release agent is applied to the upper surface of the web approximately ½" in from one of its lengthwise edges (adjacent to edge 52). The leading end of the web is then folded lengthwise (in the machine direction) in the middle to form the outer edge 34 and then again toward the edge with the release agent to form the inner edge 44. Such in-line folding techniques are well known in the art. The underside of the now folded web (in particular, the second panel part 30 and the third panel 50) is coated with a pressure sensitive hot melt adhesive, such as HL-2201 commercially available from H. B. Fuller Company of St. Paul, Minn. The sheet of release liner is passed beneath the web and an upper silicon coated surface of the liner is brought into contact with the bottom pressure sensitive adhesive surfaces of the web. A nozzle is inserted between the now second and third plies to lay a ¼" bead 54 of a suitable low-tack preferably dry residue cold glue adhesive over the release agent. The web is then pulled through rollers which crease the folds (34 and 44) and bonds the second and third plies together and the release liner to the underside of the folded web.

Figure 2A:
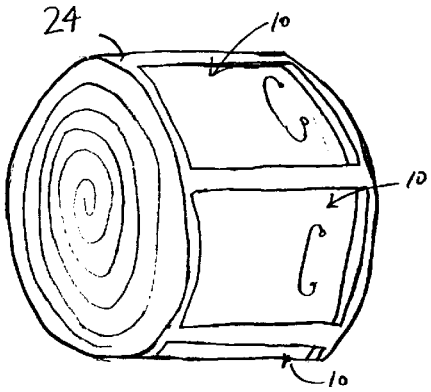
FIG. 2A is spool of handles on a wound sheet of release liner.
Figure 2B:
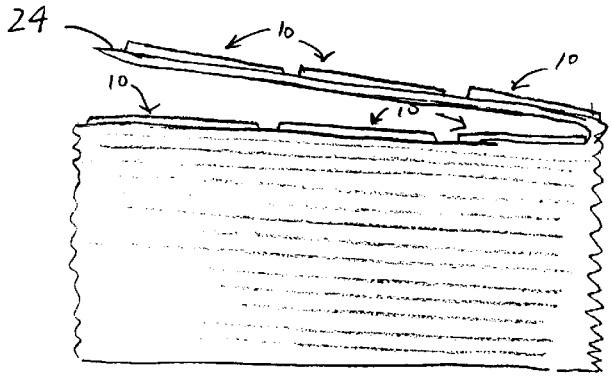
FIG. 2B shows a stack of handles on a fan-folded release liner, with three handles per fold.

Each handle then can be cut from the composite web/release liner to form individual handles, with spaces in between or not. If spaces are formed in between handles, the waste can be vacuumed up, a waste matrix can be formed by cutting all of the way around each handle so that it can be stripped off of the release liner, or the waste may be otherwise disposed of. The release liner can be cut to form individual handles, or it can be left in a single continuous strip that is either wound into a spool as shown in FIG. 2A or fan-folded into a stack as shown in FIG. 2B.

It should also be noted that more than one width of handles-in-series could be made on a press, using a double, triple, quadruple, etc. wide web of handle material, with the individual strips of handles slitted apart into individual strips, or provided as multi-wide strips.

In any case, a plurality of handles can be used with a suitable automated process that strips off the release liner and applies the handles to the packages. Preferably, with the wound or fan-folded configurations, the handles are aligned in one or more rows and spaced from one another as needed according to the size and travel rate of the packages to which they are being applied.

To manually assemble the handle 10, the release liner 24 is peeled by hand away from the adhesive second panel part 30 and the third panel 50. These panels provide a pair of base portions of the handle that can extend at any angle to adhere to the package as needed. For example, these base portions can be kept in a generally coplanar position for adhering the handle 10 to a single surface of the package, such as the top of a carton or sealed plastic packaging, as shown in FIG. 1A. Alternatively, the base portions can be straightened so that they are generally parallel to each other for attachment to opposite sides of a package, such as a bag as shown in FIG. 1B.

Figure 5:
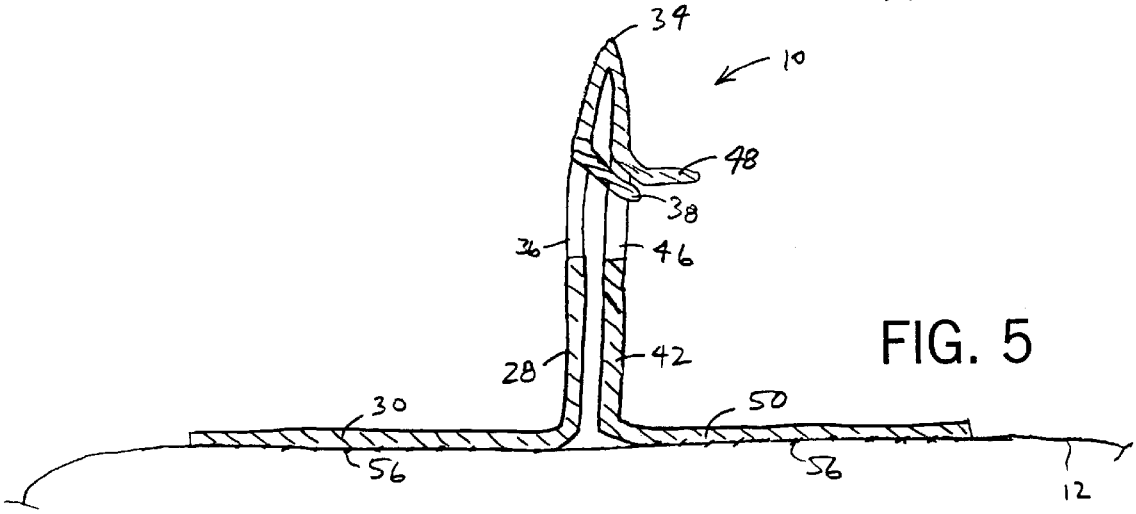
FIG. 5 is a front cross-sectional view taken along line 5—5 of FIG. 1A.

Referring to FIGS. 4 and 5, for use, the bond of the dry release adhesive 54 between the second 42 and third 50 panels can be broken by pulling the outer edge 34 upward. The first panel part 23 and the second panel 42 thus can form an upright portion of the handle 10 that is grasped by inserting one's fingers through the first and second hand receiving openings. Note that doing so will curl the flaps upward, and since the sheet is flexible, into one's hand.

The handles can be used in a number of ways. First, the handles can be applied directly to the product packaging by the product or product packaging manufacturer. This would likely be an automated assembly in which a plurality of handles were adhered to a continuous strip of release liner, however, a stack of individual handles with separate release liners may be fed into a stack feeder machine and automatically applied. Second, the handles may also be shipped to the retailer or distributor along with, but separate from, the products. Here, the handles could be separate or on a continuous folded or wound release liner, but would likely be applied manually by the sales outlet personnel or the end user. Third, the handles could be sold in retail outlets as the end product. Consumers could use the handles for carrying various items in the home, work, school or elsewhere. For example, the handles could be used for carrying books, lifting boxes for example when moving, replace torn bag handles or to lift any object without a suitable gripping area that would otherwise be awkward to carry.

While the preferred embodiment of the invention described herein has a hot melt adhesive that is designed to form a strong, permanent bond to the package or object being carried, it is within the scope of the invention to utilize an adhesive that can create a strong, but temporary bond to an object, such that the handle could be used to carry items to which one would not wish to have a permanently attached handle.

Thus, the present invention provides a adherable carrying handle that can be quickly and easily attached to a package. The handle can be made of a high strength plastic or other material and has stress relieving areas to prevent tearing at the handle openings. The handle is simply assembled by removing the release liner and pressing the base portions in contact with the one or two surfaces of the package by hand or a suitable automated process. The flat folded configuration also allows the handles to be stored, shipped and sold in bulk compactly.

Illustrative embodiments of the invention have been described in detail for the purpose of disclosing practical, operative structures whereby the invention may be practiced advantageously. However, this is intended to be illustrative only, and the novel characteristics of the invention may be incorporated in other structural forms without departing from the scope of the invention. Accordingly, to apprise the public of the full scope of the invention, the following claims are made.

What is claimed is:

1. A handle for carrying a bag, container, package or the like, formed prior to use into a flat structure releasably mounted to a release liner, the handle comprising:

a first panel having contiguous first and second panel parts, said first panel part having an outer edge and a first cut line defining a first hand receiving opening, said second panel part extending from said first panel part at a junction which is opposite from said outer edge;

a second panel extending in a plane substantially parallel with and overlapping said first panel part and being coterminous with the outer edge of said first panel part and extending to an inner edge adjacent to the junction between the first panel part and the second panel part, said second panel having a second cut line defining a second hand receiving opening at least partially in registration with said first hand receiving opening; and a third panel substantially coplanar with said second panel part and coterminous with said inner edge of said second panel;

wherein undersides of said second panel part and said third panel are adherable to a surface;

wherein a single sheet is folded to form the first, second and third plies and wherein said outer edges of said first panel part and said second panel is a fold line and wherein said inner edges of said second panel and said third panel is a fold line; and wherein said second and third panels are releasably joined by an adhesive.

2. The handle of claim 1, wherein said adhesive is a dry release adhesive.

3. The handle of claim 2, wherein said third panel has an outer edge outside of the shared outer edge of said first panel part and said second panel.

4. A handle for carrying a bag, container, package or the like, formed prior to use into a flat structure releasably mounted to a release liner, the handle comprising:

a first panel having contiguous first and second panel parts, said first panel part having an outer edge and a first cut line defining a first hand receiving opening, said second panel part extending from said first panel part at a junction which is opposite from said outer edge;

a second panel extending in a plane substantially parallel with and overlapping said first panel part and being coterminous with the outer edge of said first panel part and extending to an inner edge adjacent to the junction between the first panel part and the second panel part, said second panel having a second cut line defining a second hand receiving opening at least partially in registration with said first hand receiving opening; and a third panel substantially coplanar with said second panel part and coterminous with said inner edge of said second panel;

wherein undersides of said second panel part and said third panel are adherable to a surface; and wherein said second panel part and said third panel are releasably adhered to a release liner by a pressure sensitive adhesive.

5. The handle of claim 4, wherein said release liner has multiple handles as claimed in claim 1 adhered to it.

6. The handle of claim 5, wherein said handles are adhered to said release liner in line with one another, with the folds of the handles parallel to a machine direction, which is the direction the release liner is fed through a handle applying machine.

7. A plurality of self-adhesive handles for carrying a bag, container, package or the like, comprising a continuous sheet of release liner to which are releasably adhered a plurality of handles spaced from each other in alignment, each handle is formed into a flat structure including:

a first ply defining a first panel including contiguous first and second panel parts, said first panel part having an outer edge and a first cut line defining a first hand receiving opening, wherein an underside of said second panel part is adhered to said release liner;

a second ply defining a second panel extending in a plane substantially parallel with said first panel part and being coterminous with said outer edge of said first panel part and extending to an inner edge adjacent to the junction between the first and second panel parts of the first panel, said second panel having a second cut line defining a second hand receiving opening at least partially in registration with the first hand receiving opening; and a third ply defining a third panel substantially coplanar with said second panel part and being coterminous with said inner edge of said second panel, wherein an underside of said third panel is adhered to the release liner.

8. The handles of claim 7, wherein said second and third panels are releasably joined by a dry release adhesive.

9. The handles of claim 7, wherein the release liner is wound into a spool.

10. The handles of claim 7, wherein the release liner is fan folded.

* * * * *